US005109823A

United States Patent [19]

Yokoyama et al.

[11] Patent Number: 5,109,823

[45] Date of Patent: May 5, 1992

[54] FUEL INJECTOR DEVICE AND METHOD OF PRODUCING THE SAME

[75] Inventors: Mizuho Yokoyama; Hisanobu Kanamaru, both of Katsuta; Yoshio Okamoto; Tunemitu Kuroha, both of Ibaraki; Atsushi Koshizaka, Nakaminato; Hironori Shinozaki, Katsuta, all of Japan

[73] Assignees: Hitachi, Ltd., Tokyo; Hitachi Automotive Engineering Co., Ltd., Ibaraki, both of Japan

[21] Appl. No.: 654,677

[22] Filed: Feb. 13, 1991

[30] Foreign Application Priority Data

Feb. 23, 1990 [JP] Japan ..... 2-041036

[51] Int. Cl.[5] ..... F02M 51/08; B21K 21/08

[52] U.S. Cl. ..... 123/472; 123/432; 29/890.1; 29/890.142; 72/377; 239/492; 239/533.12; 239/601

[58] Field of Search ..... 123/472, 470, 445, 432; 239/533.12, 598, 601, 492, 494, 496; 29/890.142, 890.143, 888.01, 890.1, 890.13; 72/377

[56] References Cited

U.S. PATENT DOCUMENTS

| | | | |
|---|---|---|---|
| 3,150,442 | 9/1964 | Straw et al. | 29/890.142 |
| 3,528,613 | 9/1970 | Berlyn | 123/470 |
| 3,858,812 | 1/1975 | Williams et al. | 29/890.143 |
| 4,317,357 | 3/1982 | Moen | 29/890.142 |
| 4,519,370 | 5/1985 | Iwata | 123/472 |
| 4,773,374 | 9/1988 | Kiuchi et al. | 123/470 |
| 5,018,501 | 5/1991 | Watanabe et al. | 123/472 |

FOREIGN PATENT DOCUMENTS

| | | | |
|---|---|---|---|
| 196807 | 3/1958 | Austria | 239/601 |
| 61-152765 | 9/1986 | Japan . | |

*Primary Examiner*—Andrew M. Dolinar
*Attorney, Agent, or Firm*—Antonelli, Terry, Stout & Kraus

[57] ABSTRACT

A fuel injector device has a fuel swirling element disposed upstream of a valve seat and capable of imparting a swirling force to a fuel supplied thereto, a fuel injection nozzle orifice disposed downstream of the valve seat, and a fuel distributing adapter disposed downstream of the fuel injection nozzle orifice and capable of distributing the flow of the fuel injected by the fuel injection nozzle orifice in two directions. The adapter has an axial fuel passage having a fuel inlet of a diameter greater than that of the injection orifice and an outlet end of a substantially "8"-shape having a minimum diameter smaller than that of the inlet end. The adapter can be formed by preparing a blank having an axial fuel passage and then conducting a plastic work by a punch press on an end face of the blank so as to restrict the outlet end of the fuel passage.

11 Claims, 6 Drawing Sheets

FUEL INJECTOR DEVICE AND METHOD OF PRODUCING THE SAME

BACKGROUND OF THE INVENTION

1. Field of the Invention

The present invention relates to a fuel injuector device for injecting atomized fuel into each cylinder of an internal combustion engine. The present invention also is concerned with a method of producing such a fuel injector device.

2. Description of the Related Art

A known fuel injector device of the type shown, for example, in Japanese Unexamined Utility Model Publication No. 61-152765 is adapted to be used on an internal combustion engine in which each cylinder has two intake valves and an intake passage which is branched into two branch passage portions at a region near the intake valves. Thus, the fuel injector device associated with each cylinder has a single injection nozzle orifice for metering fuel and a fuel passage which is divided into two branch fuel passages disposed immediately downstream of the injection nozzle orifice, the branch fuel passages being inclined with respect to the injector axis so as to distribute the fuel to both intake valves of the cylinder. The axes of the branch fuel passages cross each other at a point upstream of the position where the walls of both branch fuel passages merge each other. It is necessary that the merging walls of two branch fuel passages form a keen edge so a to stabilize the angle of fuel injection and distribution of fuel to both branch fuel passages.

This known fuel injector device has the following problem. Namely, when the fuel is injected and atomized from the single injection nozzle orifice, the central portion of the atomized fuel collides with the fuel passage walls in the region where the passage branches. The particles of the atomized fuel deflected by the passage walls are joined with atomized fuel particles which have been injected into the branch fuel passages without being interfered by the passage walls, thereby to form fuel particles of greater sizes, thus adversely affecting fine atomization.

In addition, the precisions of the fuel distribution and fuel injection angle are adversely affected even by a slight error in the position (angle) and shape of the branching portion of the fuel passage.

SUMMARY OF THE INVENTION

Accordingly, an object of the present invention is to provide a fuel injector device which can promote fine atomization and even distribution of the fuel without causing any change in the injection rate.

Another object of the present invention is to provide a method of producing a fuel injector device which can promote fine atomization and even distribution of the fuel without causing any change in the injection rate.

To this end, according to one aspect of the present invention, there is provided a fuel injector device comprising: a valve seat; a fuel swirling element disposed upstream of the valve seat and capable of imparting a swirling force to a fuel supplied thereto; a fuel injection nozzle orifice disposed downstream of the valve seat; and distributing means disposed downstream of the fuel injection nozzle orifice and capable of distributing the flow of the fuel injected through the fuel injection nozzle orifice, the distributing means having an axial fuel passage bore having inlet end adjacent the fuel injection nozzle orifice and an outlet end remote from the fuel injection nozzle orifice. The outlet end is substantially "8"-shaped and has a minimum diameter smaller than that of the inlet end.

According to another aspect of the present invention, three is provided a method of producing a fuel injector device of the type that has a valve seat, a fuel swirling element disposed upstream of the valve seat and capable of imparting a swirling force to a fuel supplied thereto, a fuel injection nozzle orifice disposed downstream of the valve seat, and distributing means disposed downstream of the fuel injection nozzle orifice and capable of distributing the flow of the fuel injected through the fuel injection nozzle orifce, the method comprising: preparing a blank of the fuel distributing means having an axial fuel passage bore; and locally pressing an end face of the blank in a region around an end opening of the axial fuel passage bore so as to reduce the size of the end opening.

The axial fuel passage in the fuel distributing means may preferably be of a substantially "8"-shaped cross-section and shaped and dimensioned such that the minimum diameter of the "8"-shaped inlet end of the axial fuel passage is greater that the diameter of the fuel injection nozzle orifice and also greater than the minimum diameter of the "8"-shaped outlet end of the axial fuel passage in the fuel distributing means.

The fuel distributing means disposed downstream of the single injection nozzle orifice smoothly and evenly distribute the injected fuel from the axial fuel passage bore without causing any change in the rate of fuel injection through the injection nozzle orifice. Consequently, "dripping" of fuel is prevented in the region where the fuel passage is branched into two branch fuel passages, thus contributing to stabilization of atomization.

DESCRIPTION OF THE PREFERRED EMBODIMENTS

Figure 1:
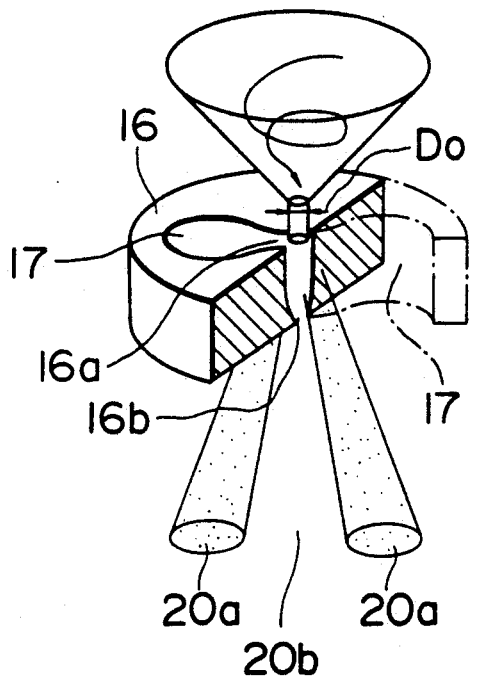
FIG. 1 is a schematic illustration of fuel distributing means incorporated in an embodiment of the present invention and shown in a state under fuel injection.
Figure 2:
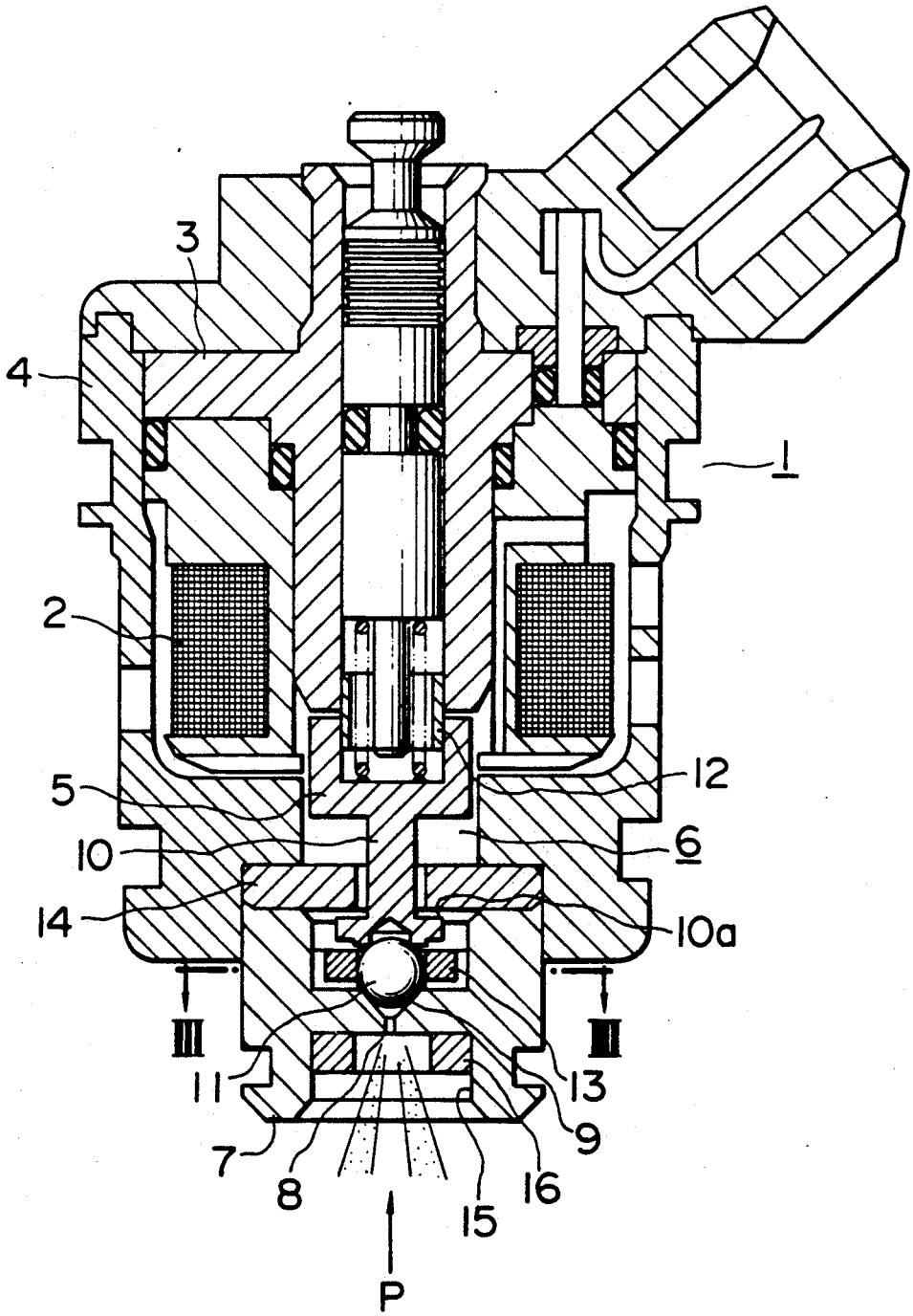
FIG. 2 is an axial sectional view of a solenoid-operated fuel injector device as an embodiment of the present invention.

A preferred embodiment of the present invention will be described with reference to FIGS. 1 to 10. FIG. 2 is a vertical sectional view of a solenoid-operated fuel injector 1 embodying the present invention. The fuel injector, generally denoted by numeral 1, is adapted to open and close a fuel passage formed between a valve and a valve seat in accordance with electric pulse signals of a duty ratio which is determined by a control unit (not shown), thereby injecting fuel at a controlled rate. The electric pulse signals are supplied to a solenoid coil 2. As the pulse current is supplied to the solenoid 2, the solenoid generates magnetic fluxes passing through a magnetic circuit formed by a central magnetic core 3, an outer cylindrical yoke 4 and a plunger 5 which axially opposes the core 3. As a consequence, the plunger 5 is attracted towards the core 3, so that a ball valve 6, which is integral with the plunger 5, is moved apart from a seat face 9 of a valve guide 7, thereby opening a fuel injection port (referred to as "orifice" hereinafter) denoted by 8. The ball valve 8 is formed by a rod 10 which is integrally connected at its one end to one end of the plunger 5 made of a magnetic material, a ball 11 welded to the other end of the rod 10 or formed integrally with the rod 10, and a guide ring 12 made of a non-magnetic material and fixed to an upper open end of the plunger 5. During stroking, the ball valve 6 is guided by the outer surface of the guide ring 12 thereof and also by the inner peripheral surface of a fuel swirling element 13 which is inserted in and fixed to the inner peripheral surface of the valve guide 7. The amount of the stroke of the ball valve 6 is determined by the distance between a flange surface 10*a* of the rod 10 and a stopper 14.

The valve guide 7 has a cylindrical portion 15 projecting in the direction away from the seat face 9. An adapter 16, which serves as a fuel distributing means of the invention, is fixed to the inner peripheral surface of the cylindrical portion 15.

Figure 3:
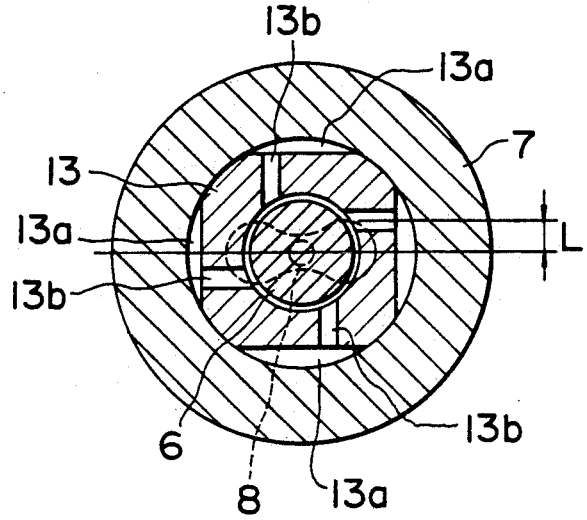
FIG. 3 is a sectional view taken along the lone III—III of FIG. 2.

FIG. 3, which is a sectional view taken along the line III—III of FIG. 2, shows the above-mentioned fuel swirling element 13 which supplies a swirling flow of fuel to the orifice 8. The fuel swirling element 13 has axial grooves 13*a* and radial grooves 13*b* as well as a central bore. In the illustrated embodiment, the axial grooves 13*a* are formed by the surfaces of the element 13 which oppose the inner peripheral surface of the valve guide 7 across D-shaped gaps as will be seen from this figure. Fuel is introduced through the axial grooves 13*a* into the central bore of the fuel swirling element 13 through the radial grooves 13*b* which direct the fuel into the central bore in an eccentric manner, i.e., towards points which are offset from the axis of the central bore. Consequently, a swirling force is imparted to the fuel which is supplied to the orifice 8 in the valve guide 7. The swirling force is adjustable by varying the amount L of eccentricity or offset.

Figure 6:
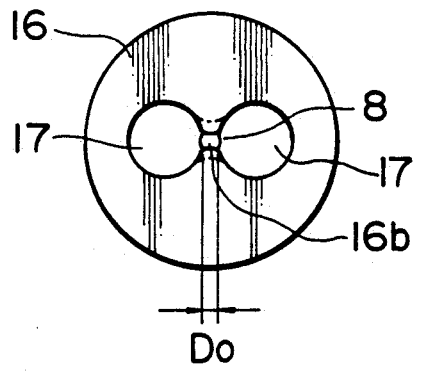
FIG. 6 is a bottom view of the fuel distributing means as viewed in the direction of an arrow P in FIG. 2.
Figure 6A:
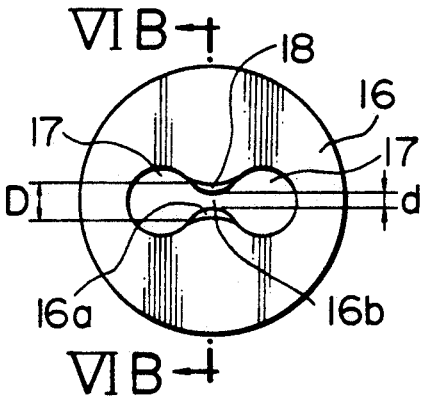
FIG. 6A is a top plan view of an adapter serving as the fuel distributing means.
Figure 6B:
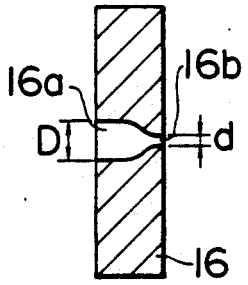
FIG. 6B is an axial sectional view taken along the line VIB—VIB of FIG. 6A.

FIGS. 6, 6A and 6B illustrate the adapter 16 serving as the fuel distributing means.

The adapter 16 has an axial central fuel passage formed by an inlet bore 16*a* of a diameter slightly greater than that of the orifice 8 and an outlet bore 16*b* of a diameter slightly smaller than that of the orifice 8, and a pair of large-diameter fuel passages 17 which are parallel to the inlet bore 16*a* and radially communicated therewith and having axes equally spaced from the axis of the bore 16*a*. The inlet bore 16*a* is defined by continuous arcuate walls 18 each of which has a suitable radius of curvature and which smoothly merge the inner peripheral walls of the passages 17.

Figure 4:
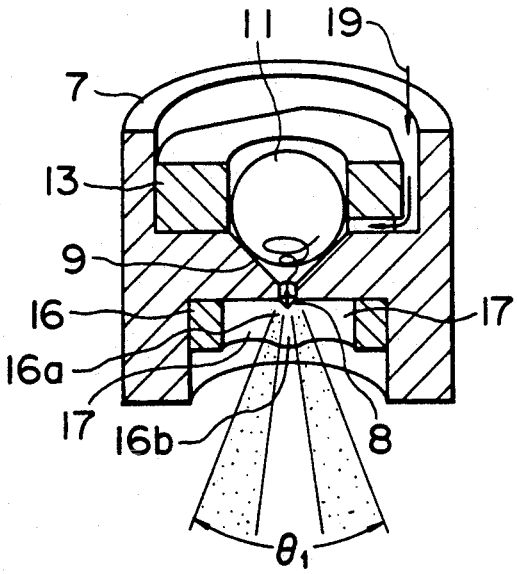
FIGS. 4 and 5 are enlarged sectional views of critical portions of the embodiment shown in FIG. 2.
Figure 5:
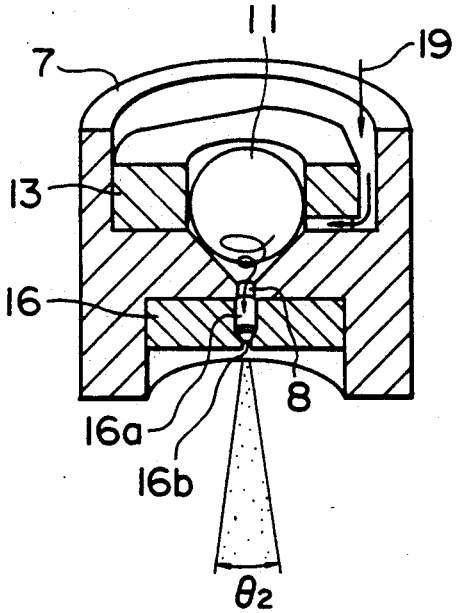

FIGS. 4 and 5 show a manner in which fuel is introduced into and injected from a critical portion of the fuel injector. It will be seen that the flow of the fuel diverges at an angle $\phi_1$ in a first plane extending through the axes of the pair of fuel passages 17 shown in FIG. 4, whereas, in a second plane perpendicular to the first plane, the flow of fuel is restricted so that the fuel is injected with a smaller angle $\phi_2$ of divergence, as shown in FIG. 5. More specifically, referring to FIG. 4, the fuel which is introduced from the upstream portion of the injector, as indicated by an arrow 19, flows through the fuel swirling element 13 so as to form a swirl and, after being metered by the clearance between the ball 11 and the seat face 9 of the valve guide 7, flows through the orifice 8 and enters the adapter 16. Since the inlet bore 16*a* of the central fuel passage of the adapter 16 has a diameter slightly greater than the diameter of the orifice 8, the amount of fuel atomized by and injected from the orifice 8 is not changed (i.e. not restricted) by the presence of the adapter 16.

The diverging flow of the atomized and injected fuel tends to collide with the peripheral wall of the inlet bore 16*a*. In the illustrated embodiment, however, the fuel is distributed in two directions into the pair of large-diameter passages bores 17 along the continuous walls 18 which are smoothly connected to the peripheral walls of the outlet passages 17, and, thus, is diverged from the outlet of the adapter. Representing the diameter of the orifice 8 by $D_0$, the diameter of the fuel inlet bore 16*a* by D and the diameter of the outlet bore 16*b* by d, it is possible to stabaly distribute the spray of the fuel in two directions without causing any change in the rate of injection from the orifice 8 attributable to flow resistance, by selecting the $D_0$, D and d to meet the conditions of $D_0 < D$ and $D > d$.

In case of $D < D_0$, the fuel which has been metered by the orifice bore of the diameter $D_0$ is further restricted by the fuel passage bore of the diameter D, so that the rate of injection is changed or reduced undesirably. However, if the diameter D is determined to be substantially large as compared with the diameter $D_0$, the swirling force is reduced to adversely affect the angle of distribution of the atomized fuel in two directions, as well as the size of the atomized fuel particle. Preferably, the diameter D is determined to meet the condition of $D = 1.1\ D_0$ or so.

In the described embodiment, the proportion of the fuel portion injected in the region near the axis of the injector is reduced, so that the amount of fuel which attaches to the portions other than the engine intake valves is decreased. It is, therefore, possible to effectively supply atomized fuel into an engine at a rate which well satisfies the demand by an engine control unit.

More specifically the fact that the proportion of the fuel portion injected in the region around the axis of the injector is decreased means that, when the described injector is used on an engine having a pair of intake valves for each cylinder, the proportion of the fuel portion which collides with the wall disposed between the intake valves is substantially diminished to ensure a better mixing of the atomized fuel with the air. This greatly reduces delay of response in transition period of the engine operation and enables the engine to operate with better response.

Furthermore, the described fuel injector is capable of atomizing the fuel into fine particles to an extent equivalent to that attained by the known upstream-swirl type fuel injectors, thus offering an effective measure for reducing noxious exhaust components such as hydrocarbon.

The diameter of the fuel inlet bore 16*a* of the adapter 16 can suitably be selected in accordance with the desired spraying angles $\phi_1$ and $\phi_2$ and state of distribution to be attained.

Figure 7:
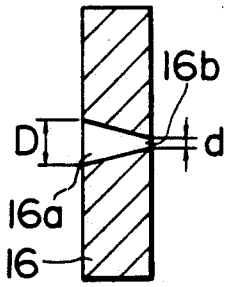
FIG. 7 is a sectional view similar to FIG. 6B but illustrating a modification to the adapter shown in FIGS. 6, 6A and 6B.

FIG. 7 shows a different embodiment in which the diameter D of the inlet bore 16*a* is determined to avoid any substantial change in the rate of atomization. For instance the diameter D is preferably determined to be about 1.1 to 1.5 times the diameter $D_0$ of the orifice 8. In the embodiment shown in FIG. 6B, the inlet bore 16*a* of the diameter D extends over a certain length and is connected to an intermediate tapered portion which is connected to a straight outlet bore 16*b* of the diameter d. In the embodiment shown in FIG. 7, the fuel passage is continuously tapered from the inlet 16*a* of the diameter D to the outlet 16*b* of the diameter d. In either case, the design must be such as not to obstruct the passage of the fuel sprayed from the orifice 8.

Figure 8:
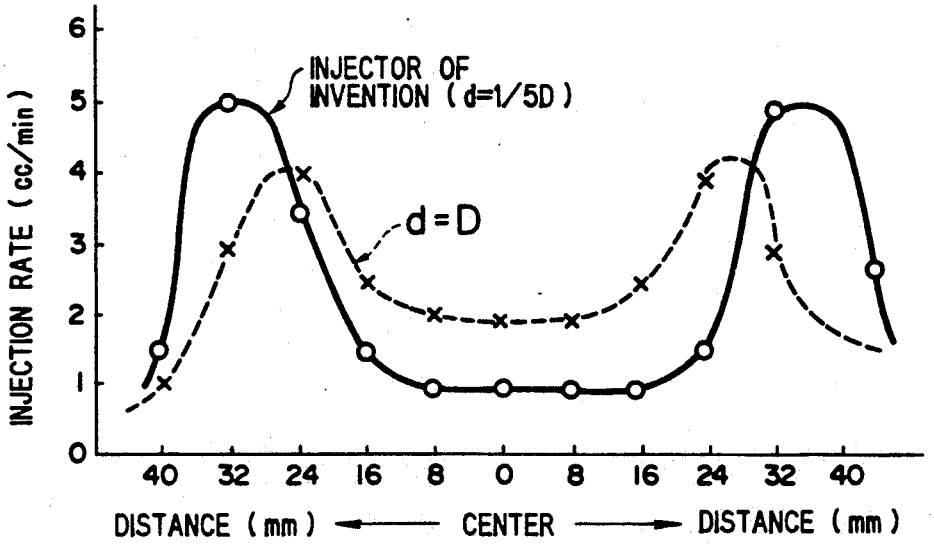
FIG. 8 graphically shows fuel injection characteristics of injectors.
Figure 9:
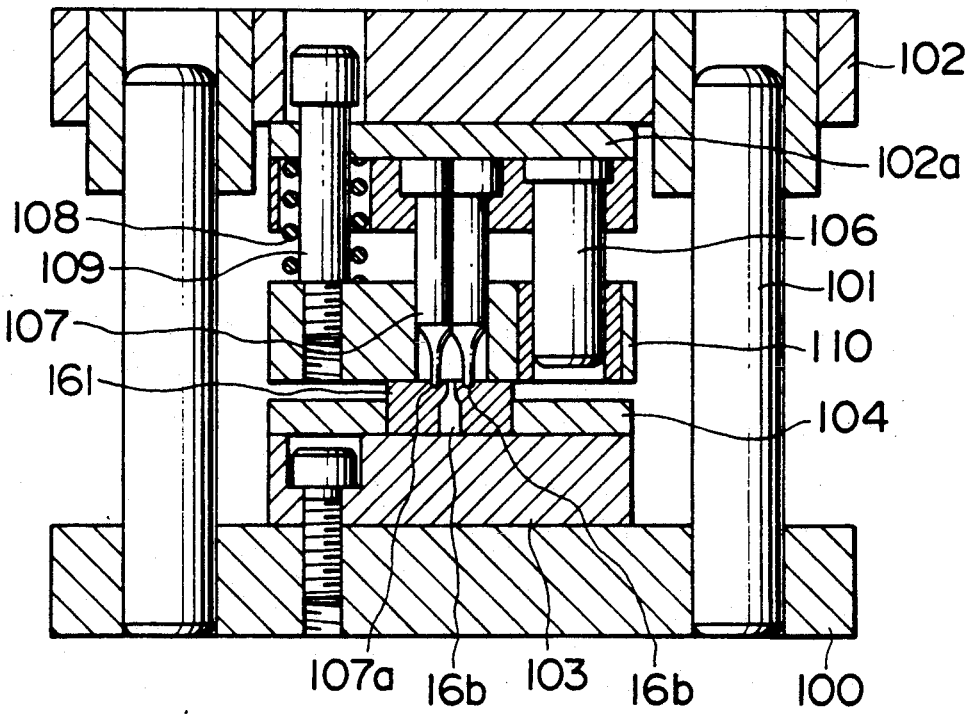
FIG. 9 is a sectional view of an apparatus for producing the adapter.

The state of atomization of fuel will be described with reference to FIG. 8. It will be seen that, when the diameter D of the inlet bore 16*a* is determined to be equal to the diameter d of the outlet bore 16*b*, the amount of fuel distributed and jetted in each of the two directions is as small as 4 cc/min, whereas the amount of fuel jetted to the central region is comparatively large. This means that the distribution of the fuel in two directions is not conducted satisfactorily. In contrast, when the outlet bore 16*b* is restricted to the diameter d which is one fifth (1/5) the inlet diameter D, distribution of fuel in two directions is enhanced to reduce the amount of fuel jetted to the central region, thus preventing "drip" of the fuel in the central region.

A description will be now made of a process for forming fuel passage bores in the adapter 16 with specific reference to FIGS. 9 to 12.

An upper die set 102 is set on a lower die 100 for vertical movement along rod pins 101. A backing plate 103 is fixed to the lower die 100. A guide plate 104 is mounted on the backing plate 103.

A sub-guide pin 106 for determining the punch stroke and a punch 107 are fixed to the underside of the upper die set 102 through a punch plate 102*a*.

Numeral 108 denotes a product pressing spring which is disposed around a guide pin 109 and extendes between the punch plate 102*a* and a stripper 110 which guides the punch 107 and the sub-guide pin 106.

Figure 10:
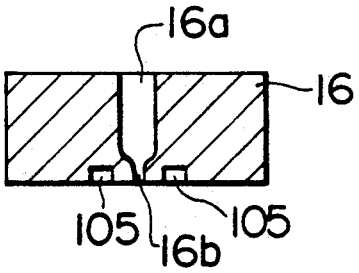
FIG. 10 is an axial sectional view of an adapter produced by the apparatus shown in FIG. 9.
Figure 11:
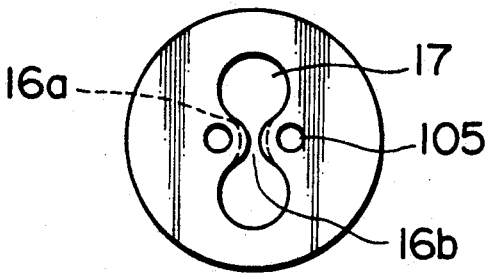
FIG. 11 is a bottom view of the adapter shown in FIG. 9.

In operation, an adapter blank 161 having formed therein the fuel passage bores 16*a* and 17 is placed on the backing plate 103. The adapeter blank 161 is usually made of a stainless steel since the adapter is used in contact with combustion gases in an engine. Subsequently, the punch 107 is lowered until a stopper comes into effect. The lowering of the punch 107 is usually conducted by controlling the upper die set. As a result, a pair of circular punch pins of the punch 107 press the central region of on end face of the adapter blank 161 at diametrically opposed two points outside an axial central bore in the blank. Consequently, dents 105 of several millimeters depth are formed in the end face of the adapter blank 161 and, at the same time, the material of the blank is plastically deformed radially inwardly only at the portions near the dents 105 to reduce the diameter of one end of the axial central bore in the blank 161 to about one fifth of the diameter D, as shown in FIG. 10, to form a substantially 8-shaped opening in said one end face of the adapter blank 161.

Figure 12:
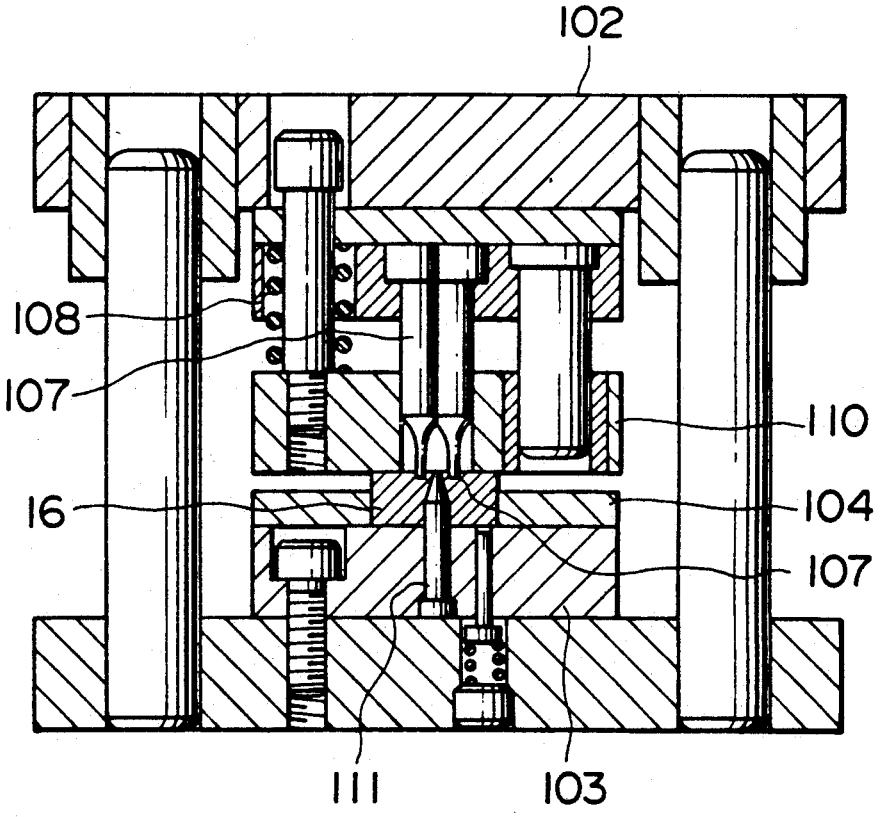
FIG. 12 is a sectional view of a modified apparatus for producing the adapter.

FIG. 12 shows a modification of the process for forming the adapter 16. In this modification, a mandrel pin 111 is set in the adapter blank 161 when the latter is placed in the die, so as to prevent undue deformation of the fuel passage bores 17 which may otherwise occur by plastic deformation during punching.

Thus, in the described process of producing the adapter, the outlet opening of the fuel passage bore can be shaped exactly and easily by punching. This operation can be conducted repeatedly for a mass-production of the adapter with a high degree of uniformity of quality. The dimensional precision is further improved to enhance the reliability of the product when the punching is conducted with the assistance of the mandrel pin as in the described modification.

As will be understood from the foregoing description, the present invention provides a fuel injector device which can promote atomization and distribution of the atomized fuel without adversely affecting the rate of injection from the injection nozzle orifice, thus improving ignitability of the injected fuel.

The invention also provides a method which can shape the outlet opening of the fuel passage bore in the adapter by plastic deformation of the material effected by a punch press and, thus, is suited to a mass-production of the fuel injector with a high degree of uniformity of quality.

What is claimed is:

1. A fuel injector device comprising: a valve seat; a fuel swirling element disposed upstream of said valve seat and capable of imparting a swirling force to a fuel supplied thereto; a fuel injection nozzle orifice disposed downstream of said valve seat; and distributing means disposed downstream of said fuel injection nozzle orifice and capable of distributing the flow of the fuel injected through said fuel injection nozzle orifice, said distributing means having an axial central fuel passage bore having an inlet end adjacent said fuel injection nozzle orifice and an outlet end remote from said fuel injection nozzle orifice, said outlet end being substantially "8"-shaped and having a minimum diameter smaller than that of said inlet end.

2. A fuel injector device according to claim 1, wherein the outlet end of said axial fuel passage bore is shaped by plastically deforming the outlet end surface of a blank material of said distributing means.

3. A fuel injector device according to claim 1, wherein said distributing means comprises a metallic adapter and wherein said axial fuel passage bore is progressively narrowed towards the downstream end.

4. A fuel injector device according to claim 2, wherein said minimum diameter of said outlet end of said axial fuel passage bore in said distributing means is smaller than the diameter of said fuel injection nozzle orifice.

5. A fuel injector device comprising: a valve seat; a fuel swirling element disposed upstream of said valve seat and capable of imparting a swirling force to a fuel supplied thereto; a valve guide having a fuel injection nozzle orifice disposed downstream of said valve seat; and distributing means disposed downstream of said valve seat and capable of distributing the flow of the fuel injected through said fuel injection nozzle orifice, said distributing means comprising an adapter disposed in and fixed to said valve guide concentrically therewith, said adapter having an axial through-hole extending through said adapter, said axial through-hole having an inlet end of a diameter greater than that of said injection nozzle orifice and an outlet end of a substantially "8"-shaped configuration having a minimum diameter, smaller than that of said injection nozzzle orifice.

6. A fuel injector device according to claim 5, wherein said outlet end said axial through-hole in said adapter is shaped by plastically deforming the portion of the material of an adapter blank in a region around said outlet end of said axial through-hole.

7. A method of producing a fuel injector device of the type that has a valve seat, a fuel swirling element disposed upstream of said valve seat and capable of imparting a swirling force to a fuel supplied thereto, a fuel injection nozzle orifice disposed downstream of said valve seat, and distributing means disposed downstream of said fuel injection nozzle orifice and capable of distributing the flow of the fuel injected through said fuel injection nozzle orifice, said method comprising: preparing a blank of said fuel distributing means having an axial passage bore; and locally pressing an end face of said blank in a region around an end opening of said axial passage bore so as to reduce the size of said end opening.

8. A method of producing a fuel injector device according to claim 7, wherein the pressing is conducted by a punch having a pair of punching portions.

9. A fuel injector device for an internal combusion engine of the type that has two intake valves for each engine cylinder, said device being adapted for use with each engine cylinder and comprising: a fuel injection nozzle orifice and means for distributing injected fuel toward the two intake valves associated with the engine cylinder, said distributing means comprising a fuel distributing passage disposed downstream of and substantially coaxially with said fuel injection nozzle orifice and having an inlet adjacent said fuel injection nozzle orifice and an outlet for directing the injected fuel toward said intake valves, said fuel distributing passage having a substantially "8"-shaped cross-section and being shaped and dimensioned such that said inlet has a minimum diameter greater than the diameter of said fuel injectin nozzle orifice and also greater than a minimum diameter of said outlet of said fuel distributing passage.

10. A fuel injector device according to claim 9, wherein said minimum diameters of said inlet and outlet of said fuel distributing passage are included in a first plane containing an axis of said fuel distributing passage and wherein said inlet and outlet have substantially equal maximum diameters included in a second plane containing said axis and perpendicular to said first plane.

11. A fuel injector device according to claim 9, wherein the minimum diameter of said inlet is smoothly reduced to the minimum diameter of said outlet.

* * * * *